United States Patent [19]

Gustafson

[11] 4,046,934

[45] Sept. 6, 1977

[54] FIBROUS BUILDING ELEMENTS

[76] Inventor: Hans Hjalmar Gustafson, Tradgardsgatan 22, S-172 38 Sundbyberg, Sweden

[21] Appl. No.: 639,907

[22] Filed: Dec. 11, 1975

[30] Foreign Application Priority Data

Jan. 9, 1975 Sweden ..... 7500188

[51] Int. Cl.[2] ..... B05D 5/00; B32B 3/00

[52] U.S. Cl. ..... 428/155; 427/257; 427/267; 427/280; 428/195; 428/452; 428/484; 428/537

[58] Field of Search ..... 428/155, 484, 485, 452, 428/152, 537, 541, 195, 151, 141, 142; 427/257, 262, 267, 280, 258; 52/515, 517; 106/9

[56] References Cited

U.S. PATENT DOCUMENTS

| | | | |
|---|---|---|---|
| 2,714,560 | 8/1955 | Hookway | 427/257 |
| 2,835,639 | 5/1958 | Widmer et al. | 427/257 |
| 3,506,474 | 4/1970 | Neubaus et al. | 427/257 |
| 3,692,557 | 9/1972 | Sormani | 428/155 |
| 3,769,063 | 10/1973 | Kizawa | 428/155 |

FOREIGN PATENT DOCUMENTS

| | | | |
|---|---|---|---|
| 675,533 | 1966 | Belgium | 52/515 |

*Primary Examiner*—George F. Lesmes
*Assistant Examiner*—P. J. Thibodeau
*Attorney, Agent, or Firm*—Kinzer, Plyer, Dorn & McEachran

[57] ABSTRACT

A fibrous building element such as a panel which can be used for roofs, soffits and walls. The fibrous element is coated on the side which will be positioned on the exterior of a building structure with a material which forms a crackled surface. The crackled surface permits water vapor or steam from the interior of the structure to pass through the panel. The crackled surface presents a surface-active hydrophobic agent to prevent rain, snow and moisture from penetrating the panel. The surface-active hydrophobic agent may be applied to the outer face of the crackled surface coating or may be mixed in the crackled surface coating.

3 Claims, 2 Drawing Figures

FIBROUS BUILDING ELEMENTS

IMPROVEMENTS IN OR RELATING TO BUILDING ELEMENTS

Figure 1:
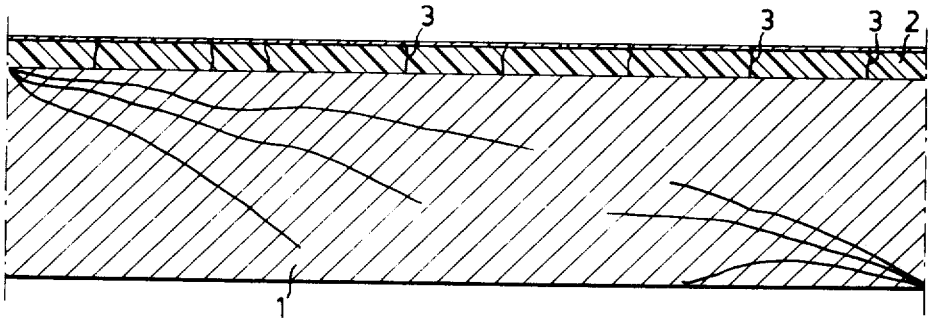

The present invention relates to fibrous building elements, such as building panels for roof structures, soffits and wall structures. More particularly, the invention relates to fibrous roofing panels which are coated on at least the side thereof which is intended to face outwardly in the erected position of the structure with a coating or layer of a coating material which forms a so-called crackled surface through which vapour, such as steam, can diffuse.

Such fibrous building elements, which may comprise, for example, hardboard, such as chipboard, coated with a water-based paint or a wax emulsion which provides a so-called crackled surface, afford the advantage whereby vapour, such as steam, can diffuse through the fibrous material from an underlying space. In this way, rotting of the underlying structure supporting the building elements as a result of, for example, condensation, is effectively prevented.

Such building elements, however, must be provided with tiles or the like which are accurately placed in position so as to prevent the penetration of water into the fibrous building elements from the outside, such penetration rapidly resulting in the collection of water on the underside of the building element.

In view of this it has been preferred to utilized building elements having a water-tight outer surface, although such a surface inhibits the diffusion of vapour through said building element and creates the problem of condensation on the inner surface of the building element. The term "inner" and "outer" as used here refer to the direction in which the respective wide surfaces of the building element face in the finally erected position of said element.

The main object of the invention is therefore to provide a building element, such as a building panel, which will permit vapour to diffuse through the panel from an underlying space, which may be heated, and to prevent water from penetrating through the outer surface of the panel.

Accordingly this invention consists in a fibrous building element which is coated on at least the outwardly facing side thereof with a layer of coating material which forms a crackled surface in a manner to permit vapour to diffuse through said building element, wherein said layer is supplemented with a surface-active hydrophobic substance to prevent the penetration of water into the building element through the crackled surface thereof.

The material which supplements said crackled surface may be of any suitable type, such as the wax emulsion which is retailed under the trademark KENO SIZE A32 by the Swedish Company Kema-Nord, a conventional silicone oil, a fat emulsion or an oil emulsion which form a semipermeable, hydrophobic film and which prevent water droplets from penetrating the cracks of the crackled surface and into the building element. It should be noted that the phrase "material which forms a crackled surface" also relates to a coating comprising small discrete surfaces formed, for example, by discrete wax droplets. Thus, rainwater and condensation from the undersurface of the building element will run down the surface of said element and depart along its lower edge, despite the fact that the building element has not been provided with a water tight layer of, for example, asphalt. The ability of the building element to absorb moisture can thus be fully utilized for absorbing vapour, such as steam, from the aforementioned underlying space and the risk of condensation falling onto the underlying support structure is effectively eliminated.

The surface active agent is either admixed directly with, for example, the water-based paint which is applied to at least the outwardly facing surface of the building element or is sprayed onto the crackled-surface forming layer. The surface active agent is preferably sprayed on the layer of paint whilst the paint is still wet. This does not reduce to any appreciable extent the ability of vapour to diffuse through the building element.

Figure 2:
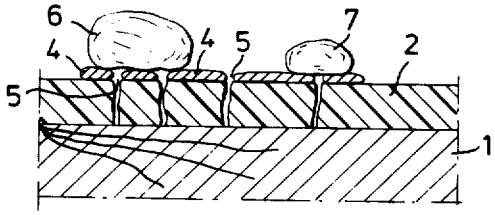

The invention will now be described by way of example only with reference to the accompanying drawing, in which FIG. 1 is a diagrammatic sectional view through a sheet of hardboard having an upper layer of paint, on which has been sprayed a layer of a substance which increases the surface tension of water, and FIG. 2 shows an element in larger scale of the surface-active layer and the paint layer.

FIG. 1 is a sectional view through a building element, such as a chipboard panel 1 which will allow vapour to pass therethrough and on the upper side of which there is provided a layer of material which forms a crackled surface, for example a water-based paint 2. The cracks in the layer 2 are referenced 3. These cracks 3 permit the passage of vapour, such as steam, through the panel 1 and the layer 2. In the illustrated embodiment the outer surface of the layer 2 is coated with a wax emulsion in which the separate wax particles are negatively charged so as to repel each other and to be oriented in mutual spaced relationship, as shown in FIG. 2. The wax particles are referenced 4 and form therebetween interstices or cracks 5 through which vapour may pass. Since the wax particles are hydrophobic, water droplets, such as the water droplets 6 and 7 are prevented from spreading and, instead, roll down the layer 2 and leave the panel 1 without penetrating the same.

It has been assumed that the substance which increases the surface tension of water has been sprayed onto the paint layer, although it is also possible to mix said substance directly in the paint 2 prior to applying said paint to the panel 1. In this instance it is convenient to use a silicone oil. It has been mentioned that the wax emulsion contains negatively charged particles, although it is also possible to use other types of wax emulsions since a crackled surface will be formed under all circumstances.

I claim:

1. A fibrous building element which is coated on at least the outwardly facing side thereof with a layer of a water-base paint which forms a cracked surface in a manner to permit vapor to diffuse through said building element and a second layer of a wax emulsion applied to the outer surface of said water-base paint to prevent the penetration of water into the building element through the cracked surface thereof.

2. The fibrous building element of claim 1 in which the wax particles of the emulsion are electrically charged.

3. The fibrous building element of claim 1 in which said second layer of said wax emulsion is applied to said first layer while said first layer of water-base paint is still wet.

* * * * *